United States Patent [19]

Francke

[11] 3,989,912

[45] Nov. 2, 1976

[54] LIGHTED PUSHBUTTON ELECTRICAL SWITCH

[75] Inventor: Richard C. Francke, Streamwood, Ill.

[73] Assignee: Illinois Tool Works Inc., Chicago, Ill.

[22] Filed: Jan. 23, 1975

[21] Appl. No.: 543,567

[52] U.S. Cl. ..... 200/159 A; 200/314

[51] Int. Cl.[2] ..... H01H 3/12

[58] Field of Search ..... 200/159 R, 159 A, 314, 200/340

[56] References Cited

UNITED STATES PATENTS

| | | | |
|---|---|---|---|
| 2,996,702 | 8/1961 | Jentges | 200/159 A |
| 3,038,053 | 6/1962 | Long et al. | 200/296 X |
| 3,104,300 | 9/1963 | Hutt | 200/159 R |
| 3,226,520 | 12/1965 | Schuchard | 200/314 |
| 3,437,775 | 4/1969 | Piber | 200/314 |
| 3,663,780 | 5/1972 | Golbeck | 200/153 J |
| 3,742,211 | 6/1973 | Groezinger | 240/152 |
| 3,777,090 | 12/1973 | Muller | 200/159 B |

FOREIGN PATENTS OR APPLICATIONS

| | | | |
|---|---|---|---|
| 786,404 | 11/1957 | United Kingdom | 200/314 |

*Primary Examiner*—Robert K. Schaefer
*Assistant Examiner*—Morris Ginsburg
*Attorney, Agent, or Firm*—Glenn W. Bowen; Robert W. Beart

[57] ABSTRACT

The present invention relates to a lighted electrical pushbutton switch which may be utilized with only slight modification to switch either one or two normally open circuits. The movable contact member comprises an octagonal-shaped plate that carries at least two pairs of deflectable contacts and a pair of guide wings. The movable contact may be modified for two circuit operation by dividing the contact member into two sections and by providing an insulating support member. The actuating pushbutton for the switch is formed with four downwardly depending legs which contact the movable contact on its upper surface while a return spring contacts the movable contact on its lower surface. The stationary contacts for the switch are supported across the interior corners of the switch thereby providing contact surfaces for the deflectable contacts of the movable contact as the actuating button is depressed, which yields a predetermined "feel" characteristic.

10 Claims, 10 Drawing Figures

LIGHTED PUSHBUTTON ELECTRICAL SWITCH

BACKGROUND OF THE INVENTION

It is desirable to be able to construct a lighted pushbutton electrical switch which may be easily adapted for the switching of either one or two normally open circuits. At the present time, with rapidly rising production costs, it is becoming more and more necessary to reduce the manufacturing costs of such a switch without sacrificing reliability. The switch of the present invention is constructed so as to achieve these objectives.

An additional problem exists if the lighted pushbutton switch is to be employed in keyboard operations. In such applications, it is highly desirable to supply a feedback or "feel" characteristic to the operator which increases abruptly when the switch is initially closed and which then drops off rapidly after the initial closing in order to reduce operator errors. Many prior switches provided a "feel" to the operator before the contact was actually electrically closed, with the result that tactile feedback was supplied to the operator at a time when contact closure had not actually been achieved, which resulted in operator errors during rapid keyboard operation. The switch of the present invention is designed to provide a feedback or "feel" characteristic that is ideally suited for keyboard applications.

DESCRIPTION OF THE DRAWINGS

The present invention is described with reference to the following drawings in which.

TECHNICAL DESCRIPTION OF THE INVENTION

Figure 1:
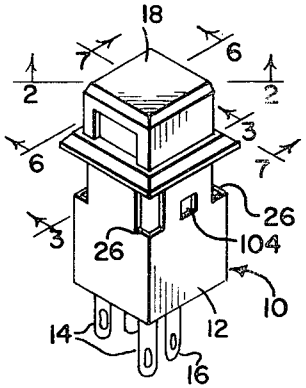
FIG. 1 is a perspective view of a switch constructed in accordance with the present invention.

The construction of the switch of the present invention is illustrated in the drawings in which the switch 10 is shown in perspective in FIG. 1. The switch 10 consists of a housing 12 which supports terminal leads 14, 16 that project from the base 13 of the switch 10. An actuating button 18 is removably secured into the open top portion 15 of the switch 10. The housing 12 is preferably a one-piece molded part formed of plastics which has slots 20 formed in the base 13 so that the terminal leads 14, 16 may be inserted into them. The corners of the lower portion of the housing 12 are constructed with inwardly projecting triangular shaped sections 21 that form a generally octagonal interior opening looking downwardly into the switch at the point where the sections 21 begin. The slots 20, for receiving the terminal leads 14, 16, extended through the base 13 just inwardly of the surfaces 29 of the sections 21. The terminal leads 14, 16 may be twisted after they project through the base 13 to hold them firmly in place in the slots 20.

The housing 12 is formed with four openings 26 in it located just under the bezel 28, each of which extend over a portion of both of the joining side walls 24 of the housing at a corner. The uppermost portion of the terminal leads 14 are folded over the upper surfaces 29 of the side walls 24 to form generally triangular shaped engagement sections 30 for engaging the moving contact 32 of the switch 10.

The terminal leads 16 for the lamp 35 also extend through slots 20 in the base 13 into the interior of the housing 12 where they each terminate in two spring contacts 34, 36, with each of the contacts 36 being approximately one-half of the width of the corresponding contacts 34. The wide contacts 34 and the narrow contacts 36 are disposed on opposite sides of the light bulb 35 for each of the terminals 16. The leads (not shown) for the lamp 35 make contact with the contact 34 and the sealing projection 37 of the bulb fits into a corresponding recess 39 in the base 13. Surrounding the contact sections 34, 36 there are a pair of arcuate wall segments 38, 40 over which a coil return spring 42 is passed. The bottom of the coil spring 42 rests on the upstanding boss 44 of the base 13 while the top of the spring 42 is forced upwardly against the elements, or element, which form the moving contact member of the switch.

Figure 5A:
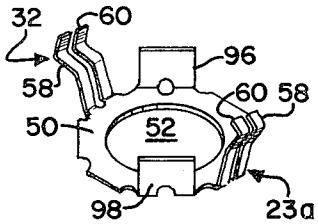
FIG. 5*a* is a perspective view of a movable contact for the switching of one normally open circuit.
Figure 5B:
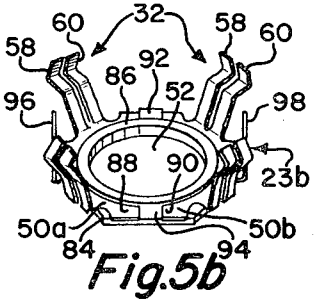
FIG. 5*b* is a perspective view of a movable contact for the switching of two normally open circuits.
Figure 4:
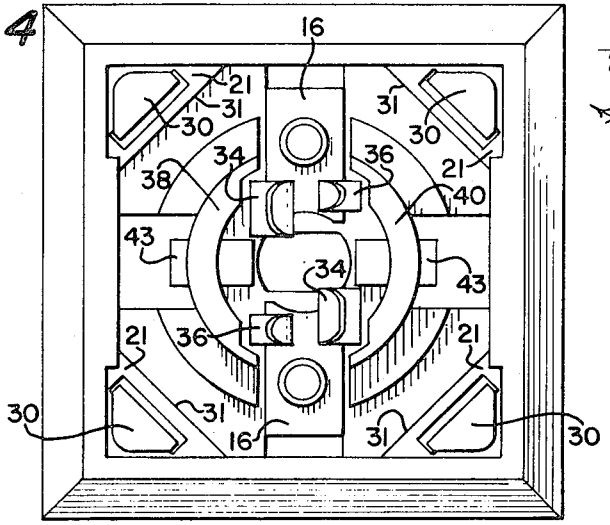
FIG. 4 is a top view looking down into the switch with the movable contact and the light bulb removed.
Figure 3:
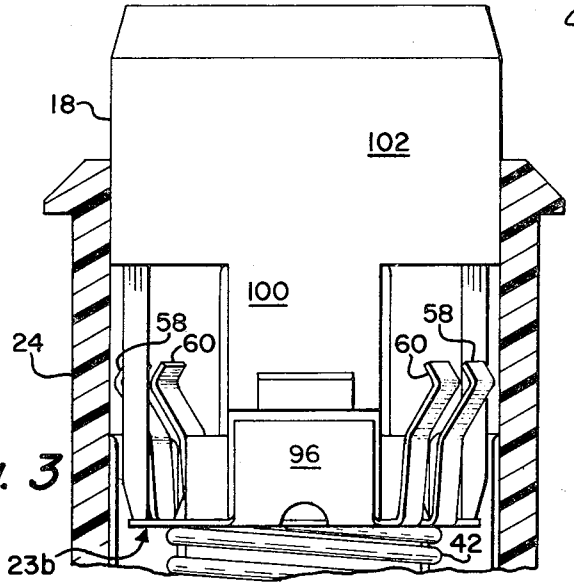
FIG. 3 is a partial cross-sectional view along the lines 3—3 of FIG. 1.
Figure 2:
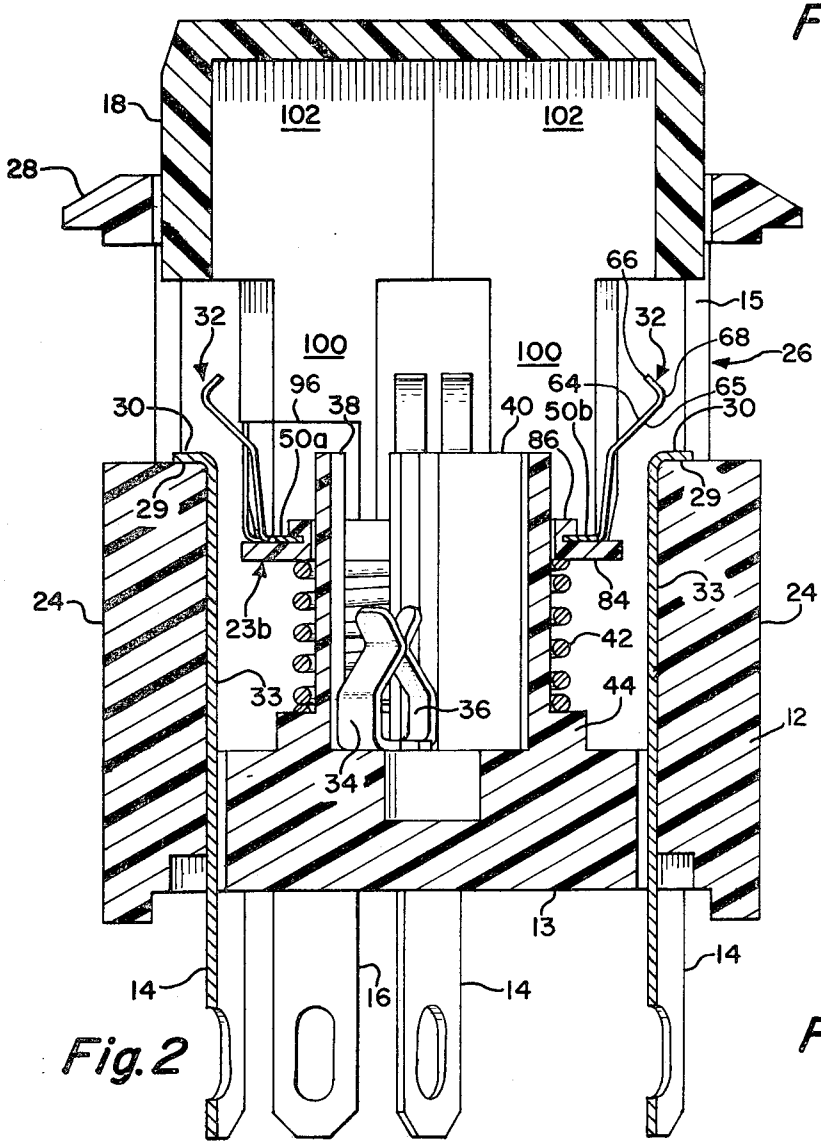
FIG. 2 is a cross-sectional view taken along the lines 2—2 of FIG. 1.
Figure 8:
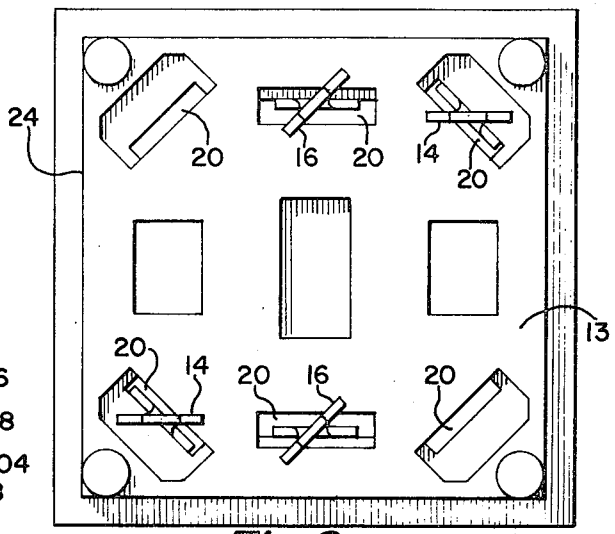
FIG. 8 is a bottom view of the switch showing the terminal leads which project from it.

The switch 10, which is illustrated in FIGS. 2 and 4, is a two-circuit switch; and it employs the movable contact member 23*b*, which is illustrated in FIG. 5b. The switch illustrated in FIGS. 3, 6, 7, 8 and 9 is a single-circuit switch; and it employs the movable contact member 23*a*, which is illustrated in FIG. 5*a*. The construction of the two-circuit and the one-circuit switch is identical except for the number of terminal leads 14 that are inserted into the slots 20 and for the construction of the movable contact members. In order to convert a single-circuit switch into a two-circuit switch, it is merely necessary to insert two additional terminal leads 14 in the slots 20 to utilize the movable contact member 23*b* instead of the movable contact member 23*a*.

Figure 9:
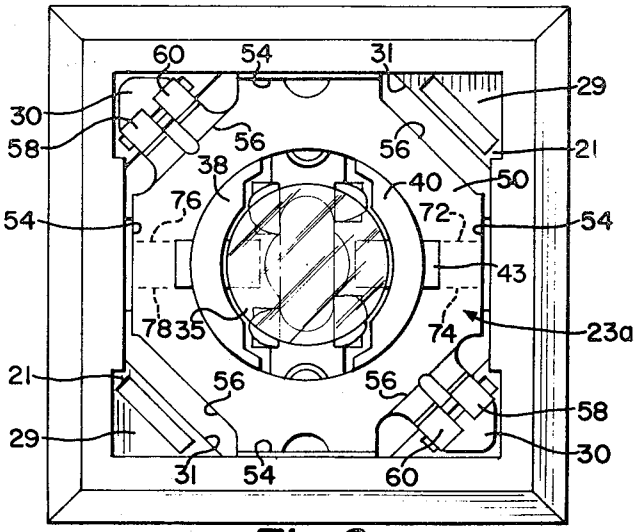
FIG. 9 is a top view looking down into the switch with the pushbutton removed, but with the light bulb and the movable contact in place.
Figure 7:
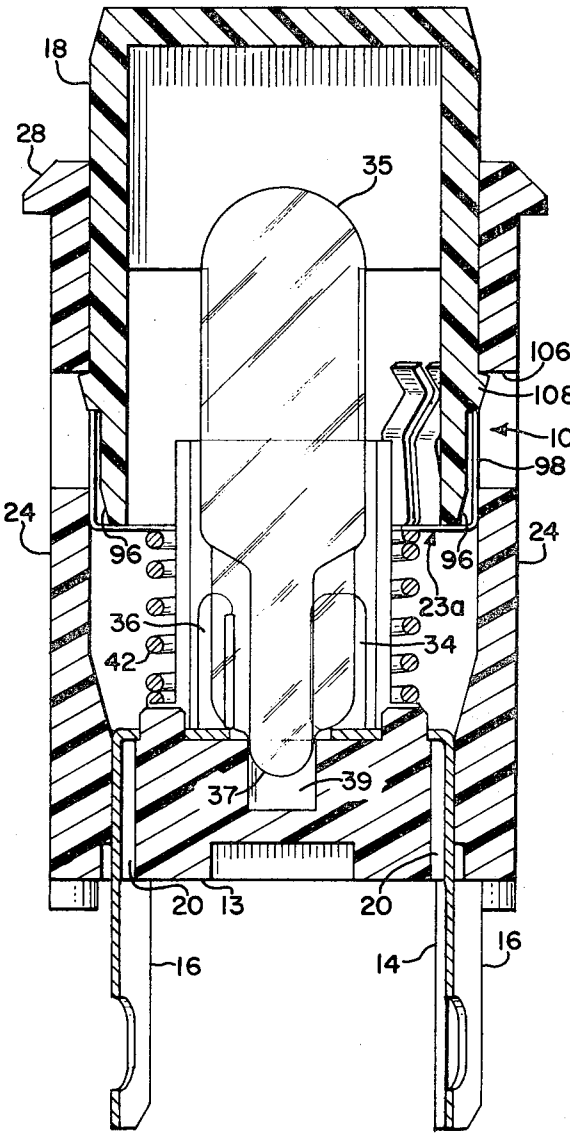
FIG. 7 is a cross-sectional view taken along the lines 7—7 of FIG. 1.
Figure 6:
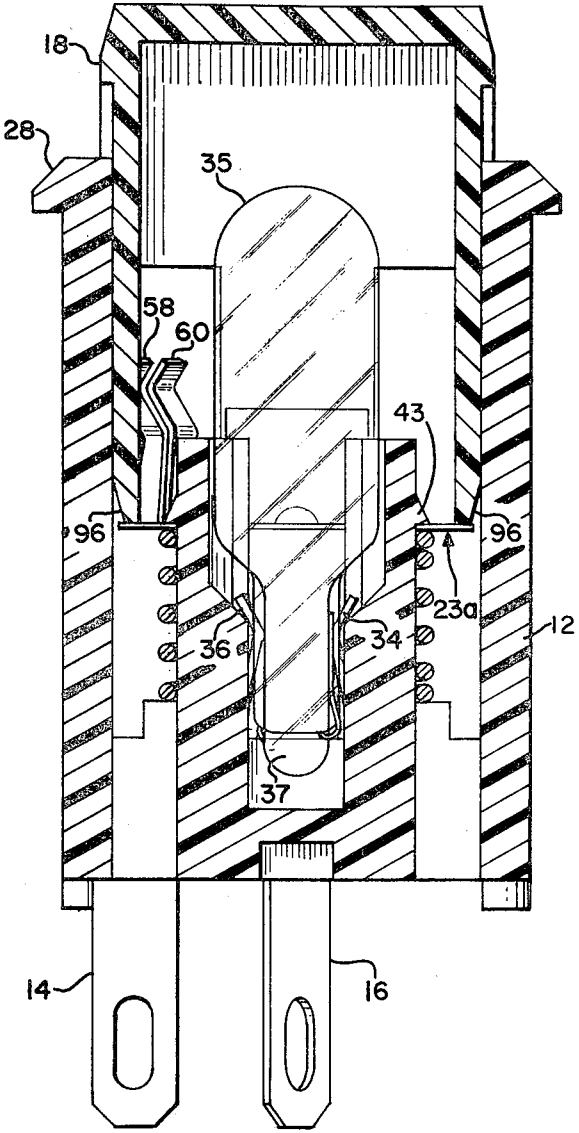
FIG. 6 is a cross-sectional view of the switch of FIG. 1 taken along the lines 6—6.

The movable contact 23*a* of FIG. 5a is preferably constructed of a conductive metal such as copper or berrylium copper. It consists of a generally octagonally-shaped plate 50 with a central aperture 52 which is of a size sufficient so that it can fit over the arcuate walls 38, 40 and thereby engage the upper end of the return spring 42. A projecting peg 43 is formed on the walls 38, 40 to provide abutments for the movable contact member 23*a* or 23*b* in deactivated condition. The four sides 54 of the plate 50 are parallel to the side walls 24 of the housing 12 while the other four sides 56 are generally parallel to the flat surfaces 31 of the triangular sections 21 which abut against the flat inner surfaces 33 of the terminal leads 14 when they are inserted into their appropriate slots 20. At diagonally opposite corners of the housing 12, and extending from sides 56 which are parallel to the outer faces 31 of the triangular sections 21, are pairs of bifurcated contacts 58, 60. The contacts are bifurcated in order to improve the reliability of the switch. Two contact pairs, as shown in FIG. 9, are required for the single-circuit switch, while four contact pairs, one on each of the sides 56, are required for the two-circuit switch.

A cross-sectional profile of the contact pairs 58, 60 is shown in FIG. 2 from which is seen that a first segment of the contacts 58, 60 extends upwardly from the plate 50 at an angle with respect to the plate which is approximately 70° to 90° to a second section 64 which extends outwardly at approximately a 35° to 55° angle with respect to the plate to a reverse bend end section that bends back towards the interior of the housing 12. The outermost portion 68 of the end section 66 is disposed outwardly over the bentover triangular engagement section 30 of a terminal lead 14 when the switch is not actuated so that as the switch is actuated, the movable contact 32 is forced downwardly; and the lower surface 65 of the section 64 comes into contact with the engagement section 30 at the instant electrical closure is made in the switch. The contacts 58, 60 are bent inwardly after initial closure, and thereafter contact area 68 will slide against the inner surface 33 of the terminal lead 14 with relatively light downward force being required after initial switch closure. In this manner, the switch of the present invention provides a tactile feel or feedback characteristic which tends to reduce operation error. Furthermore, upon release of the switch, the return spring 42 will return the movable contacts 58, 60 to their initial position shown in FIG. 2; and the operator will feel the release in pressure that results when the contacts 58, 60 spring outwardly as they travel past the sections 30.

The movable contact member 23*b* of FIG. 5b is designed primarily for use with a two-circuit normally open switch. This contact member 23*b* has two additional contact pairs 58, 60 so that, unlike the single-circuit contact member 23*a*, it has contact pairs 58, 60 on all four of the sides 56 of the plate 50. In order to operate two electrical circuits, a terminal lead 14 must also be provided at each of the corners of the housing 12; and the contact member 50 must be separated into two segments 50*a*, 50*b* which are electrically insulated from each other. If a two-circuit switch is to be constructed, four pairs of contact members 58, 60 will remain on the plate 50; while with a single-circuit switch, two diagonally opposite pairs of contacts 58, 60 would be cut-off. Also, the plate 50 of the member 23*a* may be cut on the dotted lines 72, 74, 76, 78 which extend from opposite edges 54 of the plate 50, as shown in FIG. 9. Following the cutting of the plate 50 to form the two separate contact sections 50*a*, 50*b*, they are mounted on an insulating support member 84. The insulating support member 84 is generally octagonal in shape and conforms generally to the outer dimensions of the plate 50. It has an upstanding circular boss 86 which contacts the circular rims 88, 90 of the sections 50*a*, 50*b*. The rims 88, 90 are separated by raised ribs 92, 94 on the member 84. Two of the rectangular shaped sides of the contact member 23*a*, which are parallel to the walls are bent upwardly to form a pair of wings 96, 98 which bear against the corresponding side walls 24 of the housing 12 to allow the members 23*a*, 23*b* to move up and down in a uniform manner without substantial displacement of the plate 50 from the horizontal plane.

The actuating button 18 of the switch of the present invention directly contacts the movable contact member 23*a* or 23*b*, and the construction of the button 18 contributes to the desired tactile feedback characteristic. The actuating pushbutton 18 of the switch of the present invention preferably consists of a single piece of electrically insulating material, such as plastics, which has four legs 100 thereon, each of which extend downwardly from one of the rectangular sides 102 of the pushbutton. The legs 100 are centered on the sides 102, and they preferably have a width which is approximately one-half the width of the corresponding side 102 of the pushbutton. The bottom surfaces of the legs 100 are sloped inwardly slightly, as shown best in FIG. 6, where contact with the contact members 23*a* and 23*b* is made at the end of the sloping surface 96. Contact of the legs 100 with the upper surface of the contact members 23*a* or 23*b* is made along a line parallel to the sides 54 so as to provide four contact areas which results in a substantially uniform downward force being applied to the associated contact member. Apertures 104 in the side walls 24 provide surfaces 106 that interact with wedges 108 that are integrally formed on the legs 100 so as to lock the button 18 into place on the switch 10 and to thereby allow it to move up and down during actuation and deactuation.

The invention is claimed as follows:

1. An electrical pushbutton switch comprising a housing having a plurality of wall segments and an interior opening formed of said wall segments, at least one pair of stationary contacts each contact of which is secured to one of said wall segments which is substantially parallel another of said wall segments to which the other contact of the pair of stationary contacts is secured, a moving contact member which is received in said interior opening of said housing and which has at least one flat element with a plurality of sides aligned so that the periphery of said flat element conforms to at least a portion of the periphery of said opening and with at least a pair of contact means extending from said flat element, each contact means being located on a portion of said flat element which is parallel and adjacent to one of said stationary contacts, a return bias spring which engages said moving contact member for biasing said moving contact member to an initial state, pushbutton means which also engages said moving contact member so that said moving contact member is positioned intermediate said bias spring and said pushbutton means for exerting force on said moving contact member against the bias return force supplied by said return spring, said pushbutton means comprising a pushbutton cap which has a plurality of extending legs thereon, each of which engage said moving contact member along a contact line which is substantially parallel to one of said flat element sides from which no contact means extend but which is adjacent to a flat element side from which one of said contact means extends.

2. An electrical pushbutton switch as claimed in claim 1 wherein said contact means extend outwardly over said stationary contacts when said switch is deactuated and wherein said contact means are deflected inwardly along the profile of said stationary contacts after initial contact of said contact means with said stationary contacts following the application of actuation force to said pushbutton means in a manner such that the force required to fully depress the pushbutton means drops rapidly following said initial contact of said contact means and said stationary contacts.

3. An electrical pushbutton switch as claimed in claim 1 wherein said moving contact member has a pair of wing members each of which extend from one of said flat elements sides from which no contact means extends but which is adjacent to a flat element side from which one of said contact means extends.

4. An electrical pushbutton switch as claimed in claim 1 wherein said moving contact member comprises a single, generally octagonally shaped flat element, said interior opening has a generally octagonal shape, two stationary contacts are secured in one of said wall segments of said housing which is parallel to another of said wall segments and said moving contact member comprises two contact means each of which is adjacent the one of said wall segments to which one of said stationary contacts is secured.

5. An electrical pushbutton switch as claimed in claim 1 wherein said moving contact member comprises two separate flat elements which together have a generally octagonal shape and an electrically insulating member having a generally octagonal shaped surface of approximately the same size as the octagonal shape formed by said flat elements which supports said two flat elements so they are electrically insulated from each other, said housing comprises four stationary contacts which are secured in one of said wall segments of said housing which is parallel to another of said wall segments and said moving contact member comprises two contact means on each of said flat elements each of which is adjacent the one of said wall segments to which one of said stationary contacts is secured.

6. An electrical pushbutton switch as claimed in claim 5 wherein said insulating member comprises a centrally located circular member which mates with an inner peripheral portion of each of said flat elements.

7. An electrical pushbutton switch as claimed in claim 4 wherein said contact means extend outwardly over said stationary contacts when said switch is deactuated and wherein said contact means are deflected inwardly along the profile of said stationary contacts after initial contact of said contact means with said stationary contacts following the application of actuation force to said pushbutton means in a manner such that the force required to fully depress the pushbutton means drops rapidly following said initial contact of said contact means and said stationary contacts.

8. An electrical pushbutton switch as claimed in claim 7 wherein said moving contact member has a pair of wing members each of which extend from one of said flat element sides from which no contact means extends but which is adjacent to a flat element side from which one of said contact means extends.

9. An electrical pushbutton switch as claimed in claim 5 wherein said contact means extend outwardly over said stationary contacts when said switch is deactuated and wherein said contact means are deflected inwardly along the profile of said stationary contacts after initial contact of said contact means with said stationary contacts following the application of actuation force to said pushbutton means in a manner such that the force required to fully depress the pushbutton means drops rapidly following said initial contact of said contact means and said stationary contacts.

10. An electrical pushbutton switch as claimed in claim 9 wherein said moving contact member has a pair of wing members each of which extend from one of said flat element sides from which no contact means extends but which is adjacent to a flat element side from which one of said contact means extends.

* * * * *